United States Patent [19]

Eicher

[11] 4,117,431

[45] Sep. 26, 1978

[54] MAGNETIC PROXIMITY DEVICE

[75] Inventor: Robert L. Eicher, Louisville, Ky.

[73] Assignee: General Equipment & Manufacturing Co., Inc., Louisville, Ky.

[21] Appl. No.: 805,696

[22] Filed: Jun. 13, 1977

[51] Int. Cl.[2] ..... H01H 36/00

[52] U.S. Cl. ..... 335/207; 335/306

[58] Field of Search ..... 335/207, 206, 205, 306, 335/302

[56] References Cited

U.S. PATENT DOCUMENTS

| | | | |
|---|---|---|---|
| 3,673,527 | 6/1972 | Wolf | 335/207 |
| 3,732,512 | 5/1973 | Puttick | 335/207 |
| 4,027,278 | 5/1977 | Giannini | 335/207 |

*Primary Examiner*—Harold Broome

*Attorney, Agent, or Firm*—Marshall & Yeasting

[57] ABSTRACT

A proximity device comprises a pair of connected magnets that are movable with respect to a magnetizable member located intermediate the magnets and secured in a housing. The magnets are arranged to provide a high rate of change of force between the magnets and the member as the magnets are moved by the approach or retreat of a magnetizable operator to or from an area adjacent one of the magnets and remote from the magnetizable member between the magnets.

6 Claims, 5 Drawing Figures

MAGNETIC PROXIMITY DEVICE

FIELD OF THE INVENTION

Magnetically actuated proximity devices are in common use. In general, such a device contains a magnetic member that shifts from a first to a second position as a magnetic field including the member is disturbed by the approach or retreat of a magnetizable operator. Difficulty is often experienced with such a device in that the change in force exerted by the member when the magnetic field is disturbed is insufficient to reliably operate output devices or electrical contacts.

BRIEF SUMMARY OF THE INVENTION

According to the invention a movable magnet assembly comprising a pair of permanent magnets is arranged with the magnets on either side of a fixed magnetizable member in a position such that the magnet assembly is urged in a first direction in the absence of an external magnetizable operator and in a second direction in the presence of an external operator. This arrangement provides a high rate of change of force with respect to distance for movement of the magnets relative to the magnetizable member as well as a neutral point where the magnetic pull of one magnet is equal to the pull of the other. A relatively small distortion of the magnetic field around one of the magnets, produced by the proximity of an external magnetizable operator upsets the balance of force on the magnet assembly such that the assembly moves relative to the fixed member.

A preferred embodiment of the invention is illustrated in the accompanying drawings. In the drawings.

These specific figures and the accompanying description are intended merely to illustrate the invention and not to impose limitations on the claims.

Figure 1:
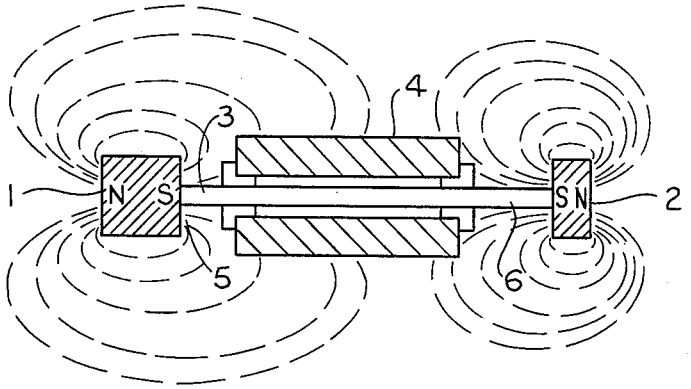
FIG. 1 is a diagrammatic sketch of a pair of magnets and cooperating magnetizable member.

Referring to FIG. 1, a primary magnet 1 and a secondary magnet 2 are held in spaced apart relation by a non-magnetic coupling member 3. A magnetizable member 4 of soft iron or a permanent magnet material is interposed between the magnets and is separated from the magnets by air gaps 5 and 6. The primary and secondary magnets are arranged with like poles facing the member 4. As shown, the south poles of the magnets face the member 4. Magnetic flux lines of the primary magnet 1 may be traced from its north pole through the air to the sides of the member 4 and thence through the member 4 and air gap 5 to the south pole of the magnet 1. Some flux lines take a shorter path by curving around directly from the north to the south pole. The longer the air gap 5 the more lines take the shorter path thus weakening the field strength in the air gap 5.

In like manner, flux lines from the secondary magnet 2 may be traced from the north pole around to the adjacent end of the member 4 and thence through the gap 6 to the south pole of the magnet. Again, some of the flux lines take the shorter path avoiding the air gap 6. The pull or attractive force between the magnets and the member 4 produces compression in the coupling member 3. The net force tending to move the magnet assembly depends upon the relative lengths of the air gaps and the strength of the magnets. As the magnets are moved from one extremity of their path of movement to the other the force varies from a large force acting in a first direction, through zero, to a large force acting in the other direction.

Figure 2:
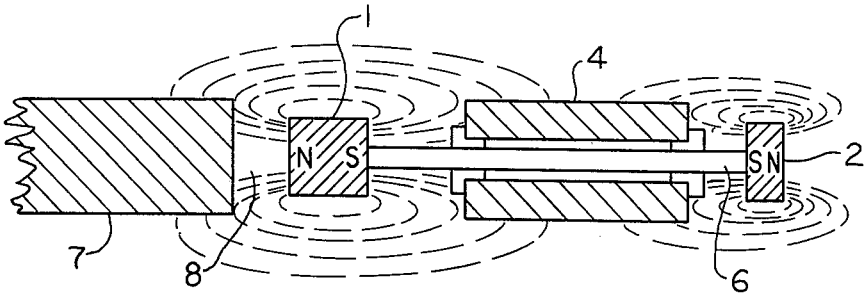
FIG. 2 is a diagrammatic sketch similar to FIG. 1 to show the distortion of the magnetic field by an external operator.

When an external magnetizable operator 7, FIG. 2, approaches the end of the primary magnet 1 the flux pattern is distorted with a portion of the flux passing across an air gap 8 between the magnet 1 and the operator 7. This generates a third force component aiding the force generated across the gap 6 of the secondary magnet 2 and opposing the force generated in the gap 5. This urges the magnet assembly to the left as shown in the sketches.

In a practical device the extent of travel of the magnets is limited to a short distance so located that in the absence of the operator 7 the magnet assembly is urged to the right as seen in the figures and in the presence of the operator 7 the magnets are urged to the left.

Figure 3:
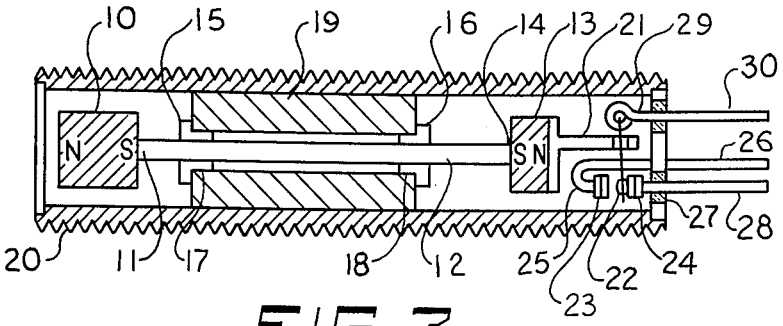
FIG. 3 is a longitudinal section of a preferred embodiment of the invention.

A magnetically actuated proximity switch embodying the invention is illustrated in FIG. 3. As shown, a primary magnet 10 is secured in a suitable manner to a first end 11 of a coupling member or connecting rod 12. A secondary magnet 13 is secured to the second end 14 of the connecting rod 12. The connecting rod 12 is slidably mounted in low friction plastic bearings 15, 16 which fit in ends 17, 18 of a sleeve 19. The sleeve 19 is secured by any suitable means in an externally threaded tube 20 serving as a housing. The end rings and sleeve may be formed of either soft iron or permanent magnet material and may be made of one or several pieces. The threaded tube 20 is preferably made of a non-magnetic material but may be made of magnetic material provided substantial radial air gaps are provided between the magnets and the tube. In any event the end closure must be non-magnetic.

In the preferred form the movement of the magnets 10, 13 is used to actuate utilization means such as for example, a counter, an electrical switch, or a pneumatic switch. While the switch may be located at any of a number of positions in the housing it is illustrated as positioned at the right end. For this purpose an operator 21 extending from the magnet 13 serves as a drive for a moving contact 22 positioned between a normally open contact 23 and a normally closed contact 24. The contact 23 is connected through a lead 25 to a terminal pin 26. Likewise, the normally closed contact 24 is connected through a lead 27 to terminal pin 28. The moving contact 22, the intermediate contact of a single pole double throw switch, is connected through lead 29 to a common terminal pin 30. To protect the bearings 15 and 16 and the contacts the housing 20 is sealed at each end, with the terminal pins brought out through glass seals. Preferably, the housing 20 is evacuated and filled with an inert gas.

The magnets, when used in this arrangement, should have high coercive force and light weight. The recently developed rare earth magnets, i.e. magnets formed of compounds of cobalt with rare earths such as Yttrium, Cerium, Lanthanum, Praseodymium, Samarium. Such magnets (as supplied by Hitachi Magnets Corp. of Edmore, Michigan) may be used as the magnets 10 and 13 to provide a large magnetic force of attraction or repulsion between the magnets and any adjacent magnetizable materials or magnets.

In the structure shown in FIG. 3 the size and strength of the magnets 10 and 13 and their distances from the ends 17 and 18 of the sleeve 19 are selected so that the net magnetically generated foce urges the magnet assembly to the right (as seen in FIG. 3), for any position of the contact 22 between the contacts 23, 24, with a force greater than the weight of the magnet assembly. This maintains adequate contact pressure between the contacts 22, 24 for all orientations of the switch in the absence of a magnetic operator.

Upon the approach of an operator 7, such as a piece of iron or steel or a properly oriented magnet, to the region adjacent the left end of the assembly, the magnetic attraction between the magnet 10 and the operator 7 overcomes the bias force urging the magnets toward the right and the magnet assembly moves to the left to close 22-23. Since the magnetic force varies as a function of the length of the air gap a toggle action ocurs thus increasing the force tending to produce motion as the magnets move. This ensures quick response and adequate force between the contacts 22-23.

Figure 4:
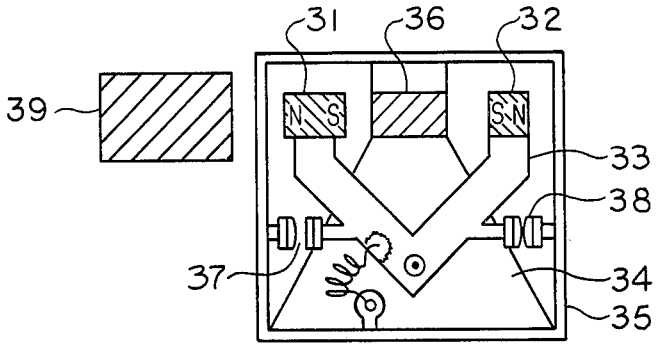
FIG. 4 is a sketch illustrating another embodiment of the invention.

While the cylindrical arrangement shown in FIG. 3 is preferred, other arrangements may also be used. One such arrangement is shown in FIG. 4. In this arrangement a first magnet 31 and a second magnet 32 are mounted on the ends of arms of a V-shaped member 33 that is pivotally mounted on a pivot pin extending from a support 34 in a housing 35. A magnetizable member 36 is mounted on the apex of the support 34 so as to be positioned between adjacent like poles of the magnets 31 and 32. A normally open contact 37 and a normally closed contact 38 serve as stops to limit the motion of the magnets relative to the housing. The magnets and the air gaps are sized, so that in the absence of an operator 39 the normally closed contact is closed. Upon the approach of the operator 39 the distortion of the flux path of the magnets creates a force moving the magnets in the direction to open the N.C. contact 38 and close the N.O. contact 37.

Figure 5:
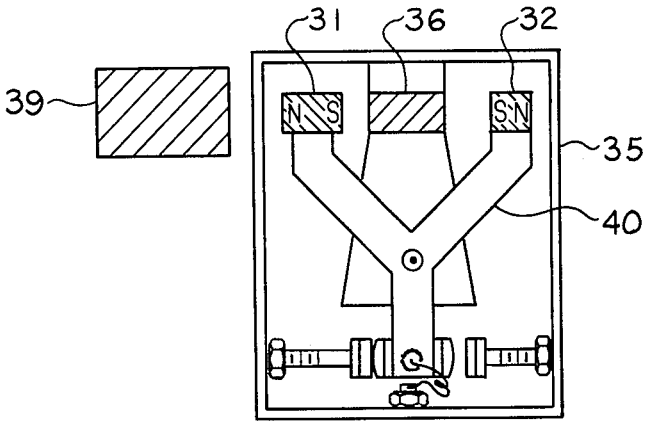
FIG. 5 is a sketch illustrating a modification of the device shown in FIG. 4.

If desired, as shown in FIG. 5, the housing 35 can be enlarged and the V-shaped member 33 changed to a Y-shaped member 40 pivoted at its center of gravity. When so constructed the device is insensitive to acceleration or orientation so that it may be used on moving members.

I claim:

1. In a device for sensing the presence of a magnetizable operator, in combination, a housing, a first permanent magnet, a second permanent magnet, non-magnetic means coupling said magnets in spaced apart position, means in the housing for guiding said magnets and coupling means for movement generally along the line of centers of the magnets, a magnetizable member interposed between said magnets and dimensioned to leave a first air gap between the member and the first magnet and a second air gap between the member and the second magnet, and utilization means responsive to the position of the magnets relative to the housing, said air gaps and magnets being arranged that the magnets are shifted from one side of an equilibrium position to the other side thereof by the presence of a magnetizable operator adjacent the first magnet.

2. A device according to claim 1, in which said guiding means comprises slide bearing mounted in said magnetizable member for slidingly supporting said coupling means.

3. A device according to claim 1, in which said guiding means comprises an arm pivoted in the housing and connected to the coupling means to extend laterally therefrom.

4. A device according to claim 1 in which said utilization means comprises at least one electrical contact connectible to an external circuit and serving to limit the travel of the magnets in a first direction.

5. A device according to claim 1 in which the housing comprises an externally threaded tube in which said magnetizable member is secured.

6. A device according to claim 1 in which the housing is of magnetizable material the inner wall surface of which is spaced from the magnets, and a window closed with nonmagnetic material positioned adjacent the first magnet.

* * * * *